US008613692B2

(12) United States Patent
Baudhuin

(10) Patent No.: US 8,613,692 B2
(45) Date of Patent: Dec. 24, 2013

(54) EXERCISE CHAIR

(75) Inventor: John Baudhuin, Santa Monica, CA (US)

(73) Assignee: Mad Dogg Athletics, Inc., Venice, CA (US)

( * ) Notice: Subject to any disclaimer, the term of this patent is extended or adjusted under 35 U.S.C. 154(b) by 26 days.

(21) Appl. No.: 12/074,866

(22) Filed: Mar. 5, 2008

(65) Prior Publication Data

US 2009/0227434 A1 Sep. 10, 2009

(51) Int. Cl.
*A63B 21/02* (2006.01)
*A47C 3/04* (2006.01)

(52) U.S. Cl.
USPC ..... 482/121; 482/123; 482/142; 297/239

(58) Field of Classification Search
USPC ..... 482/62, 111, 112, 113, 121–130, 482/133–138, 145, 904, 910, 142; D21/665, 690; 5/621, 624; 297/423.28, 297/423.3, 423.32, 423.39, 423.4, 423.41, 297/232, 239, 243, 244, 245, 248
See application file for complete search history.

(56) References Cited

U.S. PATENT DOCUMENTS 1,969,901 A * 8/1934 Pilates ..... 482/130
1,973,945 A * 9/1934 Chavin et al. ..... 482/130
2,821,762 A * 2/1958 Foose ..... 24/459
3,018,131 A * 1/1962 Krueger ..... 297/248
3,278,227 A 10/1966 Rowland
3,838,884 A * 10/1974 Faiks et al. ..... 297/248
4,066,373 A * 1/1978 Workman ..... 403/391
4,248,420 A 2/1981 Hayes
4,440,439 A * 4/1984 Szabo ..... 297/62
4,684,172 A * 8/1987 Lundquist ..... 297/248
4,809,976 A * 3/1989 Berger ..... 482/130
5,044,633 A * 9/1991 Rice ..... 482/138
5,681,250 A 10/1997 Hoover et al.
5,954,396 A * 9/1999 Kemnitzer ..... 297/248
5,967,605 A 10/1999 Stanfield
6,213,923 B1 4/2001 Cameron et al.
6,334,624 B1 * 1/2002 Giglio ..... 280/304.1
6,443,877 B1 9/2002 Hoecht et al.
6,524,355 B1 2/2003 Jenkins
6,634,997 B2 10/2003 Breibart et al.

(Continued)

FOREIGN PATENT DOCUMENTS

EP 720825 7/1996
EP 1165189 B 11/2006

(Continued)

OTHER PUBLICATIONS

Lee W. Young, Written Opinion of the International Search Authority for PCT/US 09/01355, Apr. 30, 2009.

*Primary Examiner* — Stephen Crow
(74) *Attorney, Agent, or Firm* — Maceiko IP

(57) ABSTRACT

An exercise chair which is suitable for use with Pilates and other exercises, and which is more easily stored than existing exercise chairs. The exercise chairs are positioned one behind each other in a line. Optionally, the chairs may be locked together and then tilted up as a unit so that the resulting footprint occupied on the floor is relatively small. The chair has a sturdy base having fewer moving parts to avoid sacrificed performance associated with moving parts wearing out. The chair may optional include handle sections or grips to facilitate performing exercises on the chair.

17 Claims, 22 Drawing Sheets

(56) References Cited

U.S. PATENT DOCUMENTS

| | | | | |
|---|---|---|---|---|
| 6,743,158 | B2 | 6/2004 | Giannelli et al. | |
| 6,916,279 | B2 | 7/2005 | Endelman | |
| 7,008,359 | B2 | 3/2006 | Fan et al. | |
| 7,104,937 | B2 | 9/2006 | Arbuckle et al. | |
| 7,111,902 | B1 * | 9/2006 | Conner | 297/248 |
| 7,270,628 | B2 | 9/2007 | Campanaro et al. | |
| 7,276,018 | B2 | 10/2007 | Studdard | |
| 7,322,656 | B2 * | 1/2008 | Wang | 297/423.41 |
| 7,445,586 | B2 * | 11/2008 | Gibson | 482/142 |
| 7,608,030 | B2 * | 10/2009 | Splane | 482/142 |
| 7,691,041 | B2 * | 4/2010 | Abdo | 482/142 |
| 2001/0001776 | A1 | 5/2001 | Jones | |
| 2002/0013199 | A1 | 1/2002 | Giannelli et al. | |
| 2002/0137607 | A1 | 9/2002 | Endelman | |
| 2003/0078143 | A1 * | 4/2003 | Breibart et al. | 482/130 |
| 2003/0119635 | A1 | 6/2003 | Arbuckle et al. | |
| 2003/0125173 | A1 | 7/2003 | Fan et al. | |
| 2003/0209925 | A1 * | 11/2003 | Bosman et al. | 297/239 |
| 2004/0138034 | A1 * | 7/2004 | Endelman | 482/121 |
| 2007/0037677 | A1 | 2/2007 | Splane, Jr. | |
| 2007/0184949 | A1 | 8/2007 | Weir et al. | |
| 2007/0298944 | A1 * | 12/2007 | Habing | 482/130 |
| 2008/0214371 | A1 * | 9/2008 | Alexander | 482/137 |
| 2009/0197746 | A1 * | 8/2009 | Splane et al. | 482/121 |
| 2009/0227435 | A1 * | 9/2009 | Pandozy | 482/142 |
| 2009/0264266 | A1 * | 10/2009 | Solow et al. | 482/130 |
| 2009/0270235 | A1 * | 10/2009 | Solow et al. | 482/142 |
| 2010/0009824 | A1 * | 1/2010 | Splane | 482/130 |
| 2010/0041526 | A1 * | 2/2010 | Bowser et al. | 482/123 |

FOREIGN PATENT DOCUMENTS

| | | | | | |
|---|---|---|---|---|---|
| GB | 2270266 | A | * | 3/1994 | A63B 21/04 |
| WO | WO 01/64298 | A2 | | 9/2001 | |
| WO | WO 2004/075998 | A2 | | 9/2004 | |
| WO | WO 2007/026178 | A1 | | 3/2007 | |
| WO | WO 2007/092045 | A2 | | 8/2007 | |
| WO | WO 2007/146901 | A2 | | 12/2007 | |
| WO | WO 2007/146902 | A2 | | 12/2007 | |

* cited by examiner

EXERCISE CHAIR

FIELD OF THE INVENTION

The invention generally relates to the field of exercise equipment. More specifically, the invention relates to an exercise chair that may be used for Pilates and other exercises, and/or an exercise chair that may be stored with other chairs.

BACKGROUND OF THE INVENTION

Different types of exercise are increasingly popular. One such form of exercise is Pilates, and an increasing number of Pilates studios are being established.

One form of equipment used for Pilates is the Pilates chair. Originally called the Wunda Chair, different variations of this chair have come into existence over time. However, certain characteristics of these chairs have existed for many years. For example, these chairs typically include a lever that is pressed down and that is attached to the chair by one or more springs. These springs, and the resistance they provide to the lever as the lever is pressed down, may be adjusted by repositioning the spring ends so as to stretch or compress the spring thereby providing more or less resistance.

Oftentimes, an instructor in a Pilates studio teaches a class of two or more students. Such classes are increasingly popular given the cost of one-on-one instruction. Pilates classes whereby each student uses a Pilates chair are increasingly popular because a number of exercises may be performed on a Pilates chair. Accordingly, a Pilates studio offering such classes will have a number of Pilates chairs on hand. However, space is often at a premium in Pilates studios so the storage of Pilates chairs may be an issue.

Recently, several attempts have been made to address the storability of Pilates chairs. For example, Peak Pilates has proposed a stackable chair named the MVe™ Fitness Chair which is disclosed in the pending applications having International Publication Nos. WO 2007/146901 A2 and WO 2007/146902 A2. Literature associated with this chair indicates that it weighs just over 30 pounds and that as many as five such chairs may be stacked. However, given the weight and relatively bulky configuration of this chair, it does not appear that these chairs may be easily stacked. Furthermore, in order for this chair to be stacked, the position of the lever and the transverse rod which attaches the lever to the chair, must first be repositioned. And when these chairs are later unstacked for use, the lever and transverse bar must again be repositioned.

Another chair described in the above-referenced WO 2007/146902 A2 publication involves a folding frame to reduce the size of the chair and the space required to store it. Another chair involving a folding operation is disclosed in International Publication No. US 2007/0037677 A1. However, to fold the frame, the frame includes several pivoting connections which may compromise the rigidity and feel of the chair when in use. The folding aspect of the frame involves additional moving parts which may also wear out.

It is thus an object of the invention to provide an exercise chair, such as that which may be used for Pilates exercises, that addresses the foregoing shortcomings.

SUMMARY OF THE INVENTION

One aspect of the invention allows exercise chairs to be more easily stored. To this end, chairs embodying the current invention may be positioned behind each other in a line.

Optionally, the chairs may be locked together and then tilted up as a unit so that the resulting footprint occupied on the floor is relatively small.

Another aspect of the invention involves a sturdy base having fewer moving parts and that avoids sacrificed performance associated with moving parts wearing out.

Another aspect of the invention involves a seat having holes and handle sections or grips to facilitate performing exercises on the chair.

Another aspect of the invention involves additional exercise bands and/or stability bars that may be attached to the base so that additional exercises may be performed.

DESCRIPTION OF THE PREFERRED EMBODIMENTS

Figure 1:
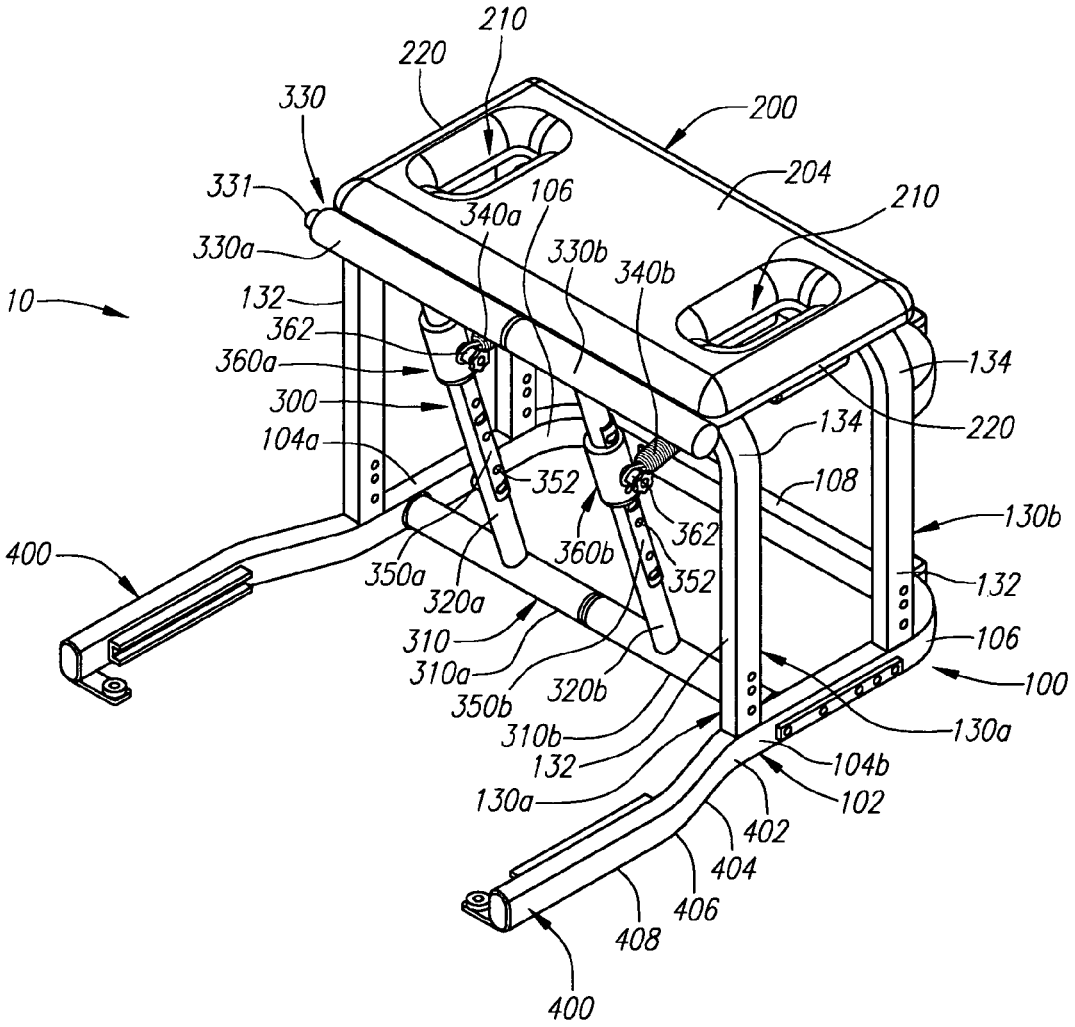
FIG. 1 shows a front downward perspective view of an exercise chair.

While there are many different embodiments within the scope of the invention, the figures and the following description illustrate preferred embodiments. The present disclosure is an exemplification of the principles of the invention and is not intended to limit the invention to the embodiments illustrated.

Though the exercise chair of the invention described herein is especially suitable for use with Pilates exercises, the invention may be used with other forms of exercise.

Referring to FIGS. 1-5, a preferred embodiment of the exercise chair of the invention is now described. The chair 10 generally includes base 100, seat 200 connected to base 100, one or more movable lever(s) 300 that is (are) connected to base 100 via rod 310 and springs 340 which impart resistance, and prongs 400. As with exercise chairs such as those dating back to the original Wunda Chair, chair 10 allows a user to press down on lever(s) 300.

The base 100 may comprise several frame members, such as u-shaped frame members, including lower frame member 102, that in turn may comprise lower side members 104*a* and 104*b*, lower curved members 106 and lower rear member 108. As shown, lower frame member 102 may comprise one contiguous piece. Alternatively, lower frame member 102 may comprise separable pieces coupled together through press fits involving a male/female arrangement between pieces, screws or other fasteners, welding, soldering or other suitable means.

Base 100 also preferably includes front seat support 130*a* and rear seat support 130*b* that may be attached to lower frame member 102. Seat supports 130*a* and 130*b* may each comprise a pair of legs 132, curved pieces 134 and upper horizontal member 136. As shown, seat supports 130*a* and 130*b* may comprise one contiguous piece. Alternatively, seat supports 130*a* and 130*b* may comprise separable pieces coupled together through press fits involving a male/female arrangement between pieces, screws or other fasteners, welding, soldering or other suitable means.

Figure 2:
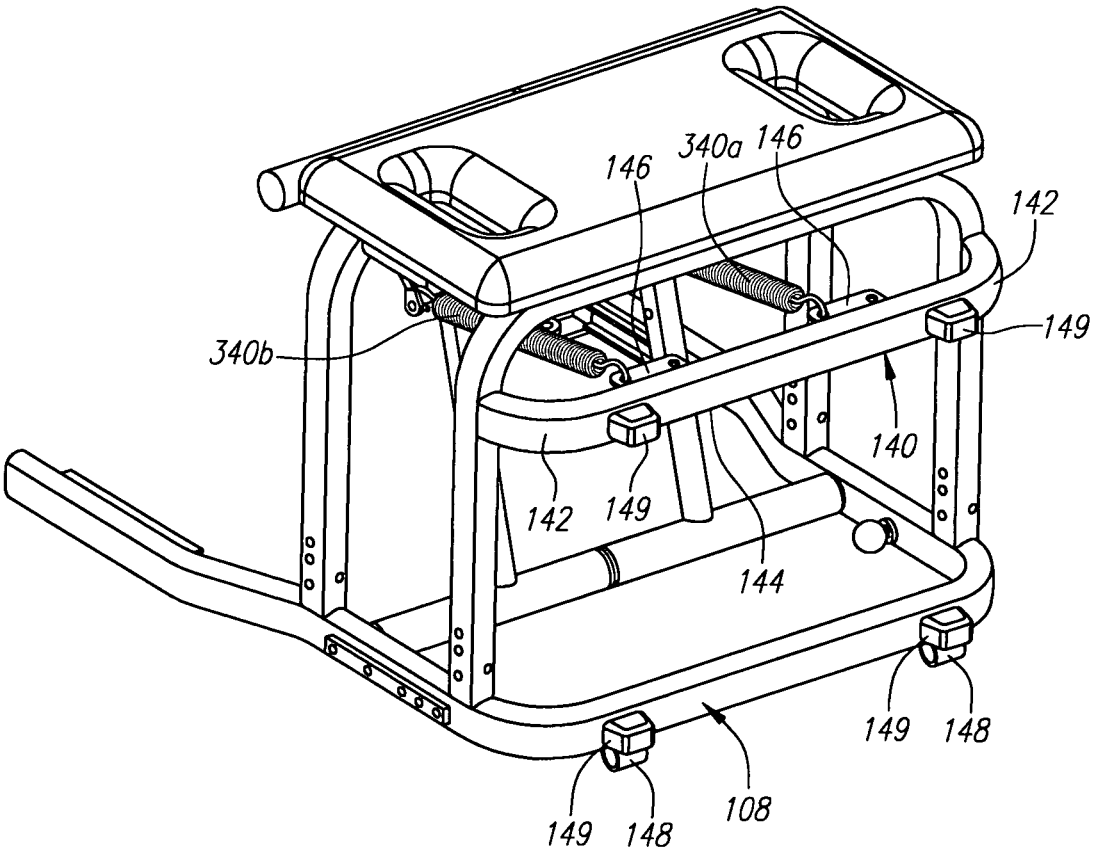
FIG. 2 shows a rear downward perspective view of an exercise chair.

As shown in FIG. 2, base 100 also preferably includes upper frame member 140 which may be attached to rear seat support 130*b*. Upper frame member 140 may comprise curved pieces 142 and upper rear member 144. One or more brackets 146 may be attached to upper rear member 144 to which one or more springs 340 may be attached as discussed in more detail later. As shown, upper rear frame member 140 may comprise one contiguous piece. Alternatively, upper rear frame member 140 may comprise separable pieces that are coupled together through press fits involving a male/female arrangement between pieces, screws or other fasteners, welding, soldering or other suitable means.

As discussed in connection with the storage aspect of the invention, and as shown in FIGS. 2-5, it is preferred that lower rear frame member 108 and upper rear frame member 140 are similarly configured.

The components of frame 100, i.e., lower frame member 102, front and rear seat supports 130*a* and 130*b*, and upper frame member 140 may be attached to each other such as by the means identified above.

In a preferred embodiment wherein multiple chairs 10 may be stored together, a pair of prongs 400 may be attached to base 100. As shown, prongs 400 may comprise one contiguous piece that may contiguously extend to base 100. Alternatively, prongs 400 may include separable components such as transition piece 402 which connects prong 400 to base 100, outward piece 404 which is directed outward, transition piece 406 and leg 408 that are coupled together through press fits involving a male/female arrangement between pieces, screws or other fasteners, welding, soldering or other suitable means. Prongs 400 may also be attached to base 100 such as by the means identified above.

Figure 3:
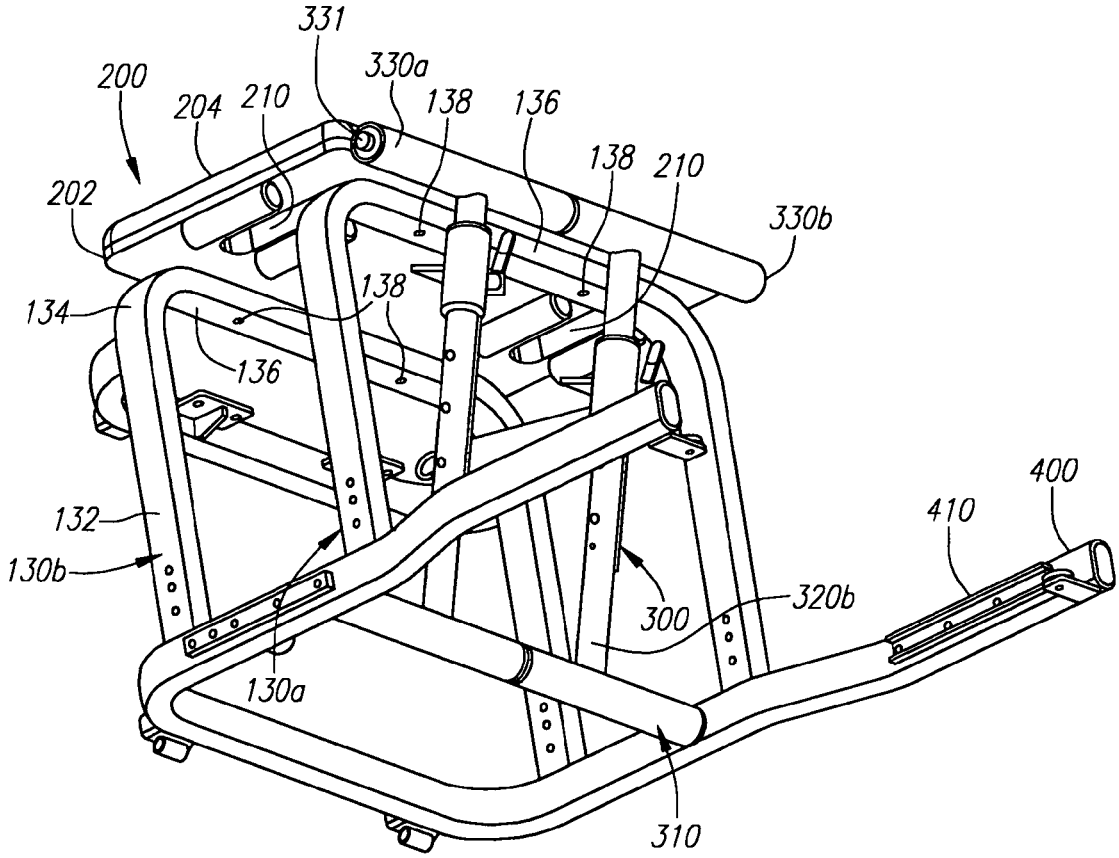
FIG. 3 shows a front upward perspective view of an exercise chair.

A seat 200 is preferably attached to base 100 via seat front and rear supports 130*a* and 130*b*. As shown in FIG. 3, seat supports 130*a* and 130*b* may include holes 138 through which screws (not shown) or some other type of fastener may extend to seat 200.

Seat 200 may comprise a flat support section 202 and a padded section 204. Seat 200 preferably includes two holes 210 for the user to grasp seat 200 to provide stability while exercising. This is advantageous especially for certain exercises requiring good balance control. This also enhances the safety of chair 10.

In a preferred embodiment, seat 200 has the same width as base 100. In this configuration, seat 200 may accommodate users of varying sizes and shoulder breadths, and still have sufficient width for holes 210. However, this may still be accomplished with seats 200 of different widths.

Figure 4:
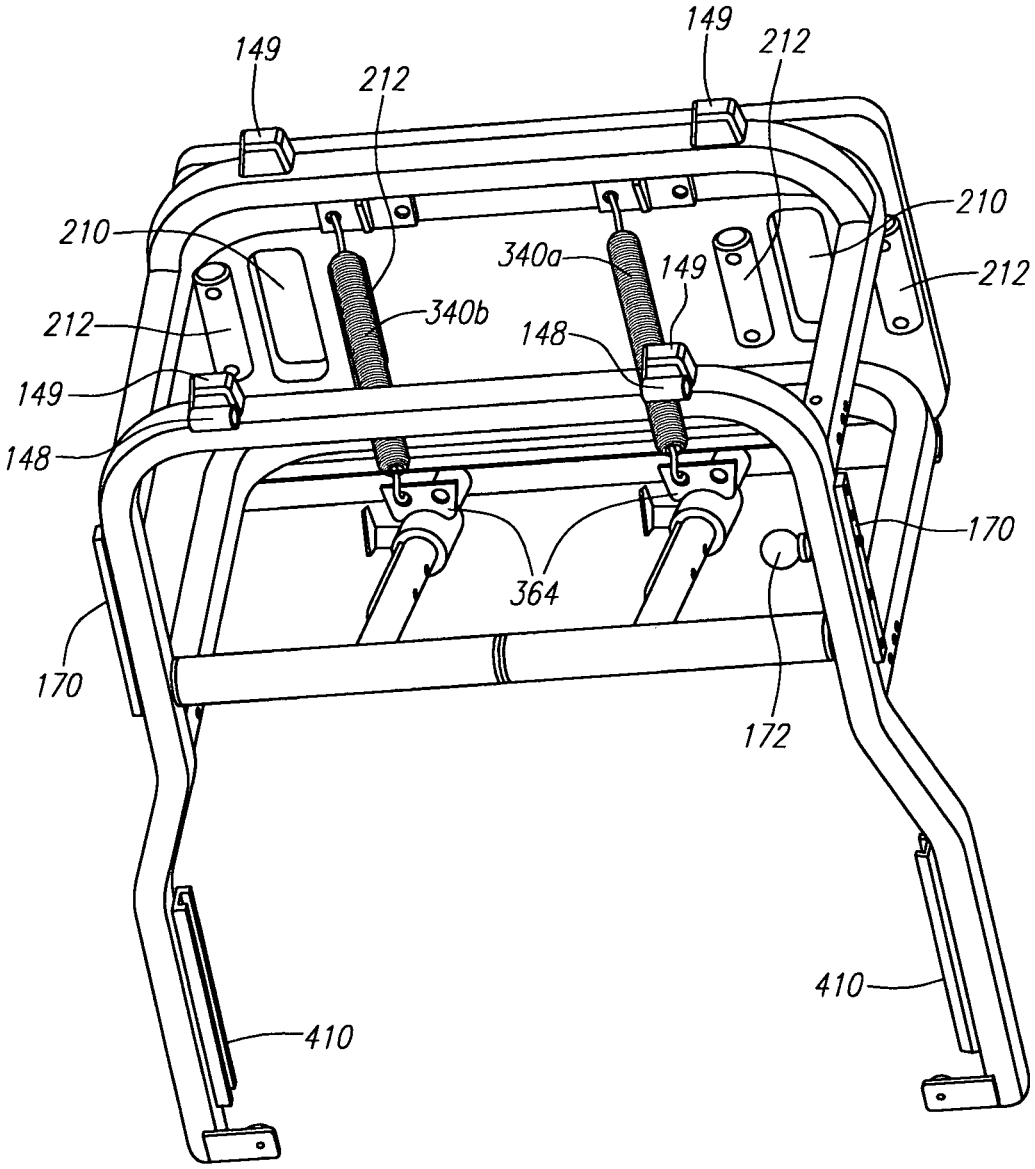
FIG. 4 shows a rear upward perspective view of an exercise chair.
Figure 5:
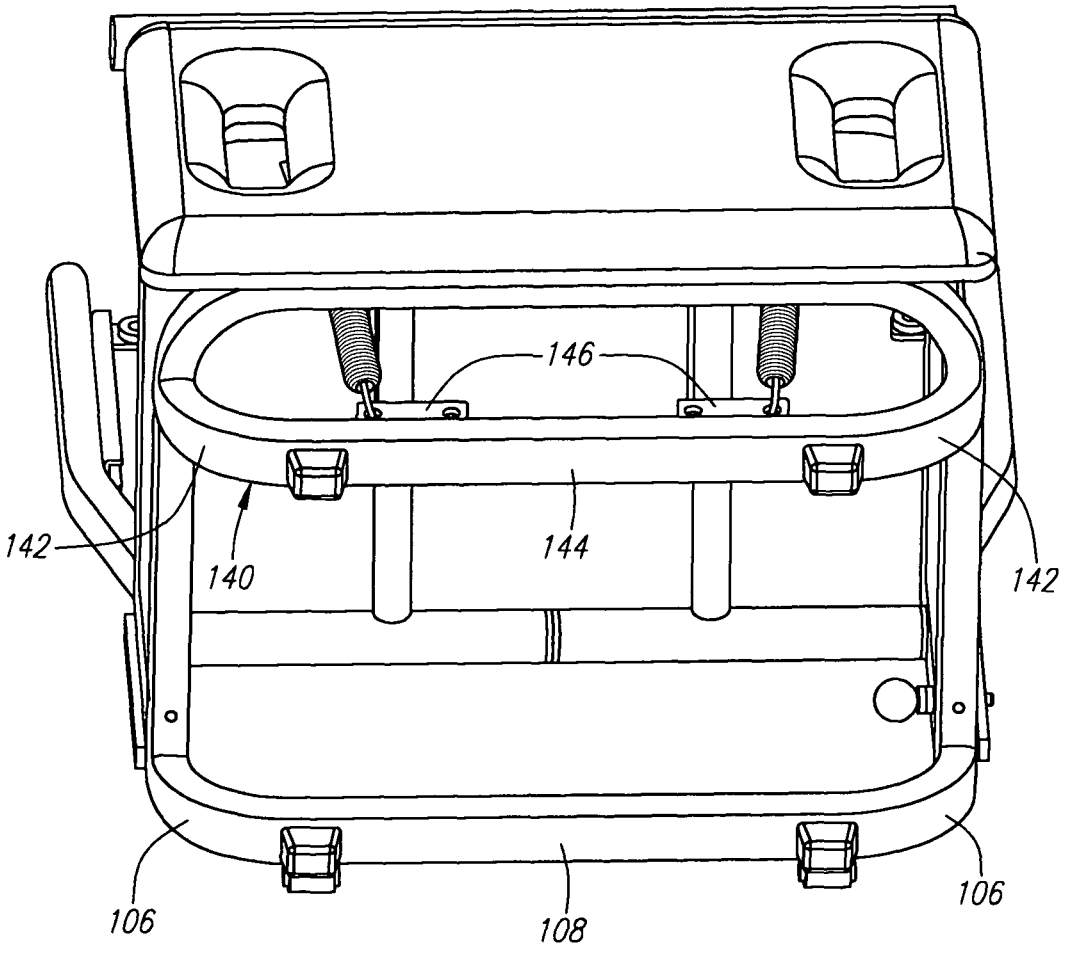
FIG. 5 shows a rear downward view of an exercise chair.

As shown in FIGS. 3 and 4, seat 200 may include grips 212 that are attached to the underside of seat 200. Grips 212 may be attached to the underside of seat 200 through screws or other suitable means. As the user extends his or her fingers through holes 210, or as the user extends his or her fingers around the side edges of seat 200, the user may curl his or her fingers to engage grips 212 to improve grip, balance and safety.

Holes 210 and grips 212 may be especially useful where the user is performing an exercise where it is intended that the user grasp the side edges of the seat. By having holes 210, the user is provided options as to how wide the user grasps the seat, i.e., at the side edges 220 or at the edge of holes 210. Also, users of different shoulder breadths may be accommodated by the multiple gripping positions.

Lever(s) 300 are now more fully described. The use of singular or plural reference to lever(s) 300 is not made to limit the invention. One skilled in the art will appreciate that the invention may involve one or multiple lever(s) 300. Lever(s) 300 may be attached to base 100. As shown, lever 300 may comprise a rod 310, lever 320 and pedal 330. Rod 310 preferably extends between and is attached to lower side members 104*a* and 104*b* of base 100. Rod 310 is preferably mounted to base 100 such that it may rotate about its axis when lever 320 is pressed down. As shown, chair 10 preferably includes two levers 320*a* and 320*b*, as well as two pedals 330*a* and 330*b* that are preferably padded, to allow the user to press down one side at a time. To this end, rod 310 may include separate rods 310*a* and 310*b* that rotate independently of each other.

However, pedals 330*a* and 330*b* may include a locking mechanism so that the levers 320*a* and 320*b* may act as one lever 320. In this configuration, when the user presses down, both levers move together. For example, rod 331 may extend through only one of the pedals 330 when multi lever operation is desired. But for single lever operation, rod 331 may be adjusted so that it extends into the other pedal. More particularly, rod 331 may be spring biased inward so that in one position, it extends through pedal 330*a* and into 330*b*. However, the rod may be pulled axially outward and rotated so that when released, it does not extend all the way through pedal 330*a* and into pedal 330*b*.

Springs 340 preferably extend between levers 320 and base 100. As shown, one spring 340*a* and 340*b* may be used for each lever 320*a* and 320*b*, but two or more springs may be used for each lever 320 which will impart more resistance to the user as he or she pushes lever(s) 320 down. Alternatively, other types of resistance, such as elastic bands, may be used instead of springs.

The ends of springs 340 may comprise hooks to attach to different parts of chair 10. As shown in FIGS. 1-2, the front end of spring 340 may be coupled to lever 320 and the back end of spring 340 may be coupled to bracket 146 which in turn is attached to upper rear member 144 of upper frame member 140 of frame 100. Alternatively, the rear end of spring 340 may be attached directly to upper rear member 144 through holes therein (not shown). The front end of spring 340 may be coupled to lever 320 at one location or alternatively, at multiple locations along lever 320 if adjustability is desired. An advantage of having the rear spring ends attach to frame 100 instead of to seat 200 is that seat 200 may be removed without removing the springs 340.

The connection of springs 340 to levers 320 is now more fully described. In one embodiment, each lever 320*a* and 320*b* may include a positioning strip 350*a* and 350*b* that may be attached to levers 320 by screws or other suitable means. Positioning strips 350 preferably include a number of holes 352 which serve as locations at which the front ends of springs 340 may be located. There may be four or some other number of holes 352. Regardless of the number of holes present, this embodiment advantageously provides identifiable locations at which to locate the front spring ends, as opposed to locating the front spring ends anywhere along levers 320. With identifiable spring end locations, the resistance of the springs 340 may be adjusted uniformly between the two levers 320. Accordingly, one side of the user's body is not inadvertently worked harder than the other.

Levers 320*a* and 320*b* may also include a collar 360*a* and 360*b*. In one embodiment, each collar 360 preferably fully encircles lever 320 for ease of adjustment and so that collar 360 does not separate from lever 320. Collar 360 preferably fits around lever 320 with somewhat of a snug fit, but with still enough play so that collar 360 may be positioned up and down lever 320.

Collar 360 preferably includes a bracket 364 (as shown in FIG. 4) which includes holes through which the front spring ends may extend. Other suitable means to attach the front spring ends to collar 360 may be used as well.

Collar 360 preferably includes a pop pin 362 around which the front spring end may extend (as shown in FIG. 1) or otherwise be attached to. Pop pin 362 may be inserted and retracted from holes 352 in positioning strip 350 according to pop pin designs such as those that have existed for some time. Accordingly, springs 340 may be adjusted to identifiable locations per holes 352.

Several alternate configurations for coupling the front spring ends to lever 320 are now described with reference to FIGS. 6-9.

Figure 6:
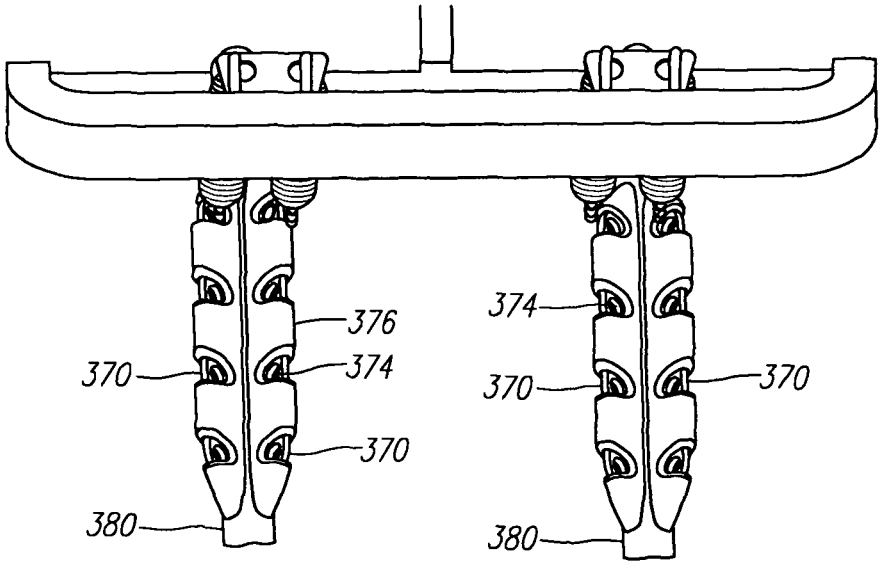
FIG. 6 shows an alternate configuration for attaching the front spring ends to the levers.

In the embodiment of FIG. 6, levers 320 may each have two flanges 370 attached thereto. Flanges 370 preferably include a number of holes 374. As shown, the front spring end such as a hook, may be positioned in any of these holes to adjust the resistance of springs 340. A decorative cover 376 may be fitted to each flange 370 for aesthetic purposes. If covers 376 are used, they preferably have holes or other cutouts to correspond to holes 374. Instead of two flanges 370, one or another number of flanges may be attached to levers 320.

Figure 7:
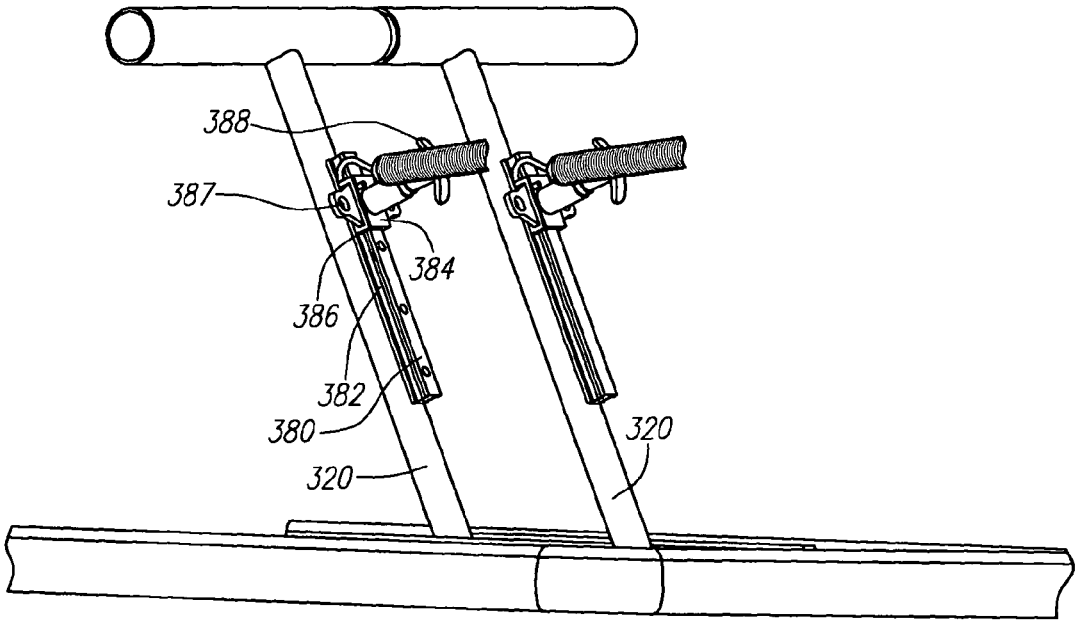
FIG. 7 shows an alternate configuration for attaching the front spring ends to the levers.

In the embodiment of FIG. 7, lever 320 may include a positioning strip 380 with a number of holes therein. The sides of strip 380 may include rails 382. A pop pin assembly 384 may be located on positioning strip 380. Pop pin assembly 384 may include rails 386 that engage rails 382 in a male/female or other suitable arrangement. Pop pin assembly includes flanges 387 having holes through which the front spring ends may extend. Pop pin assembly includes pop pin 388 which may be inserted in or retracted from the holes on positioning strip 380. In this manner, pop pin assembly 384 may be positioned up or down lever 320 in identifiable positions per the holes to adjust the resistance of spring 340.

Figure 8:
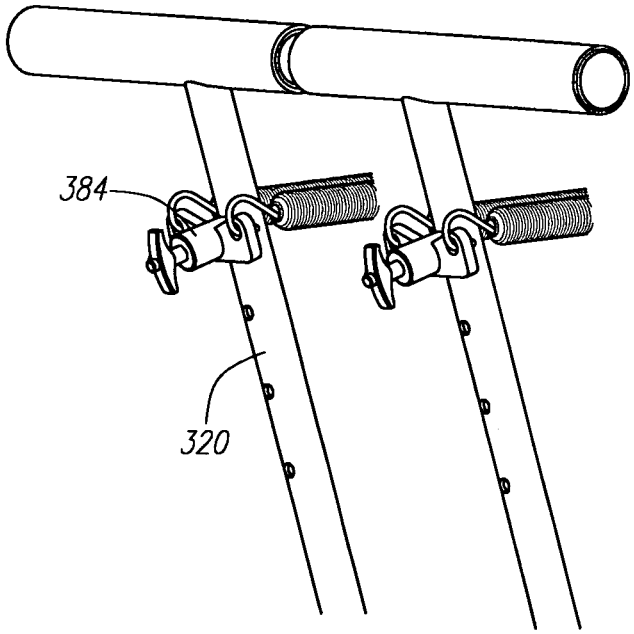
FIG. 8 shows an alternate configuration for attaching the front spring ends to the levers.

In the embodiment of FIG. 8, pop pin assembly 384 does not engage a positioning strip, but instead engages holes in lever 320. In this embodiment, pop pin assembly 384 may be separated from lever 320 and inserted into another hole. The pop pin assembly of FIG. 8 may also be mounted on the other side of lever 320 as shown in FIG. 7 (but again, without the positioning strip).

Figure 9:
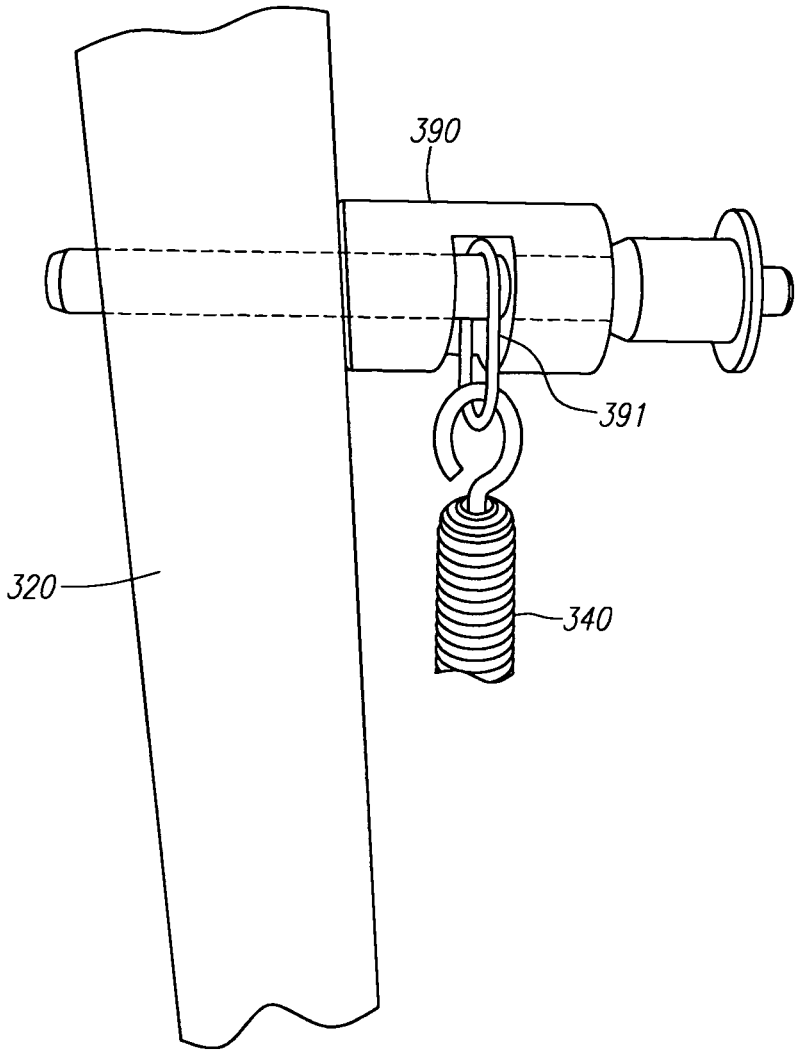
FIG. 9 shows an alternate configuration for attaching the front spring ends to the levers.

FIG. 9 shows another type of pop pin 390 that may be used to directly engage holes in levers 320. This pop pin 390 is more fully described in co-pending application U.S. Ser. No. 11/652,806, the disclosure of which is incorporated herein by reference in its entirety.

The rear end of springs 340 may also be adjustable to further vary resistance. In one embodiment, one or more rear vertical frame member(s) (not shown) may extend between lower rear member 108 and upper rear member 144. These rear vertical frame members may include multiple holes for the hooks of spring 340, or may alternately include an adjustable pop pin arrangement as discussed in connection with the foregoing embodiments of attaching the front spring ends to lever 320.

Figure 17:
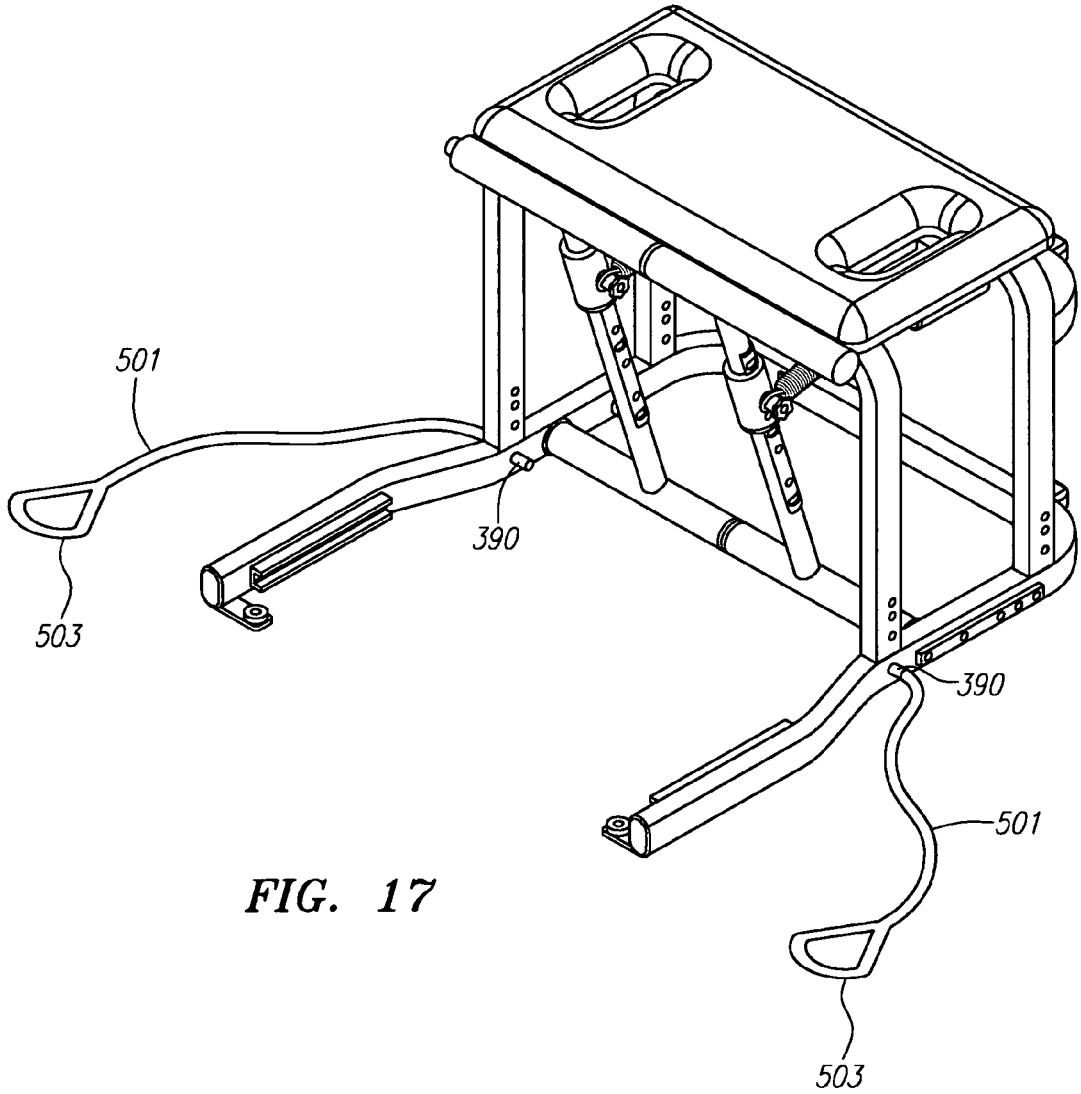
FIG. 17 shows an exercise chair having elastic members attached to the base.

As shown in FIG. 17, pop pin 390 (or other type of attachment means) may engage holes 101 in base 100. These pop pins 390 may be attached to elastic members 501 that may comprise stretchable cord or other suitable material. Handles 503 may be attached to the ends of cords 501. The cords 501 in FIG. 17 are shown laying on the ground, but the user may grasp one or both handles 503 while sitting or kneeling on seat 200, or standing beside seat 200 and use them to perform curls or some other type of exercise.

Figure 18:
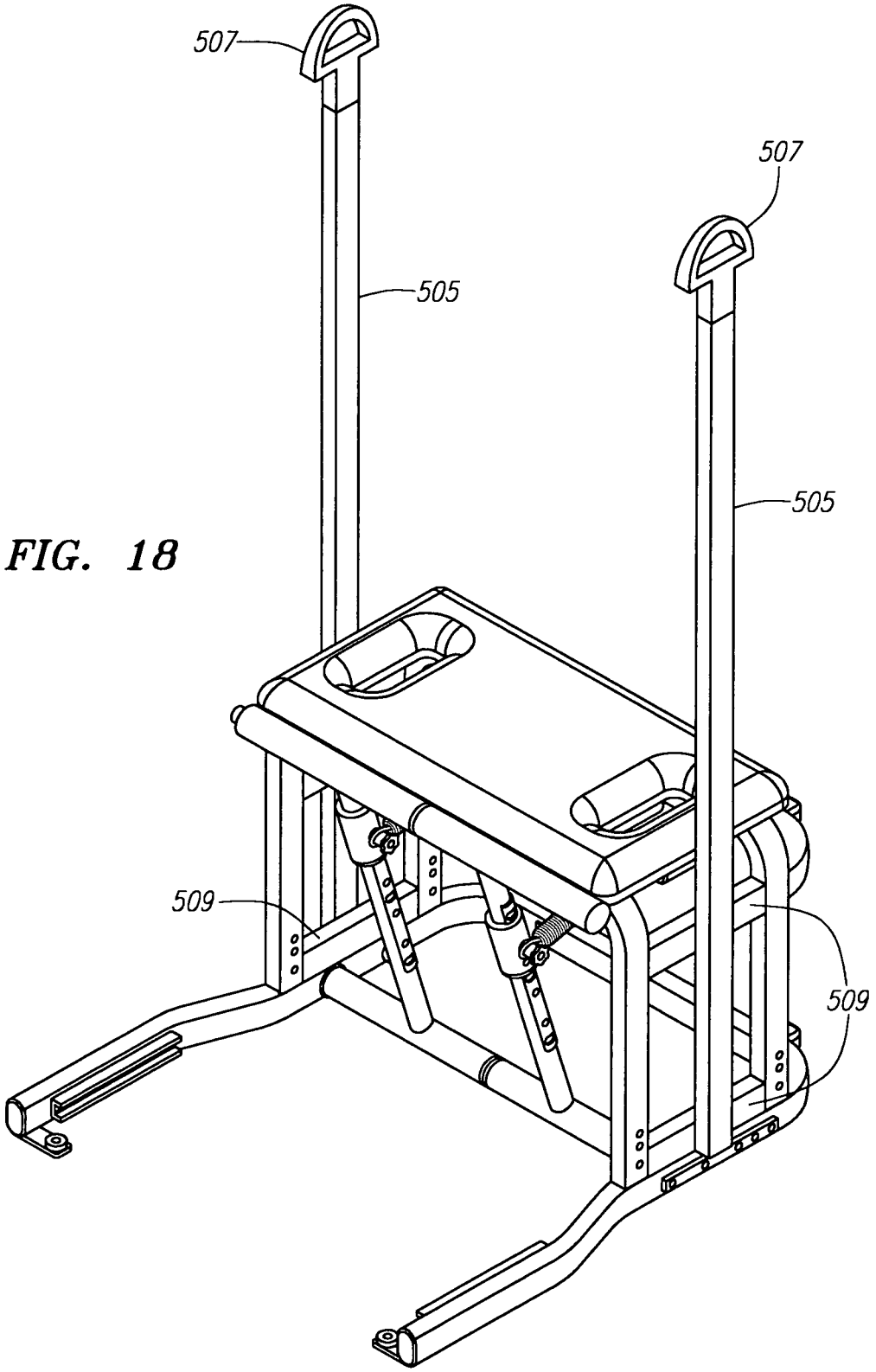
FIG. 18 shows an exercise chair with stability bars.

As shown in FIG. 18, chair 10 may include stability bars 505 that include handles 507. Stability bars may attach to base 100 such as by members 509. These allow the user to perform other exercises with chair 10, e.g., exercises where the user grasps handles 507 to suspend himself or herself off chair 10 while pressing down on pedals 330.

Figure 10:
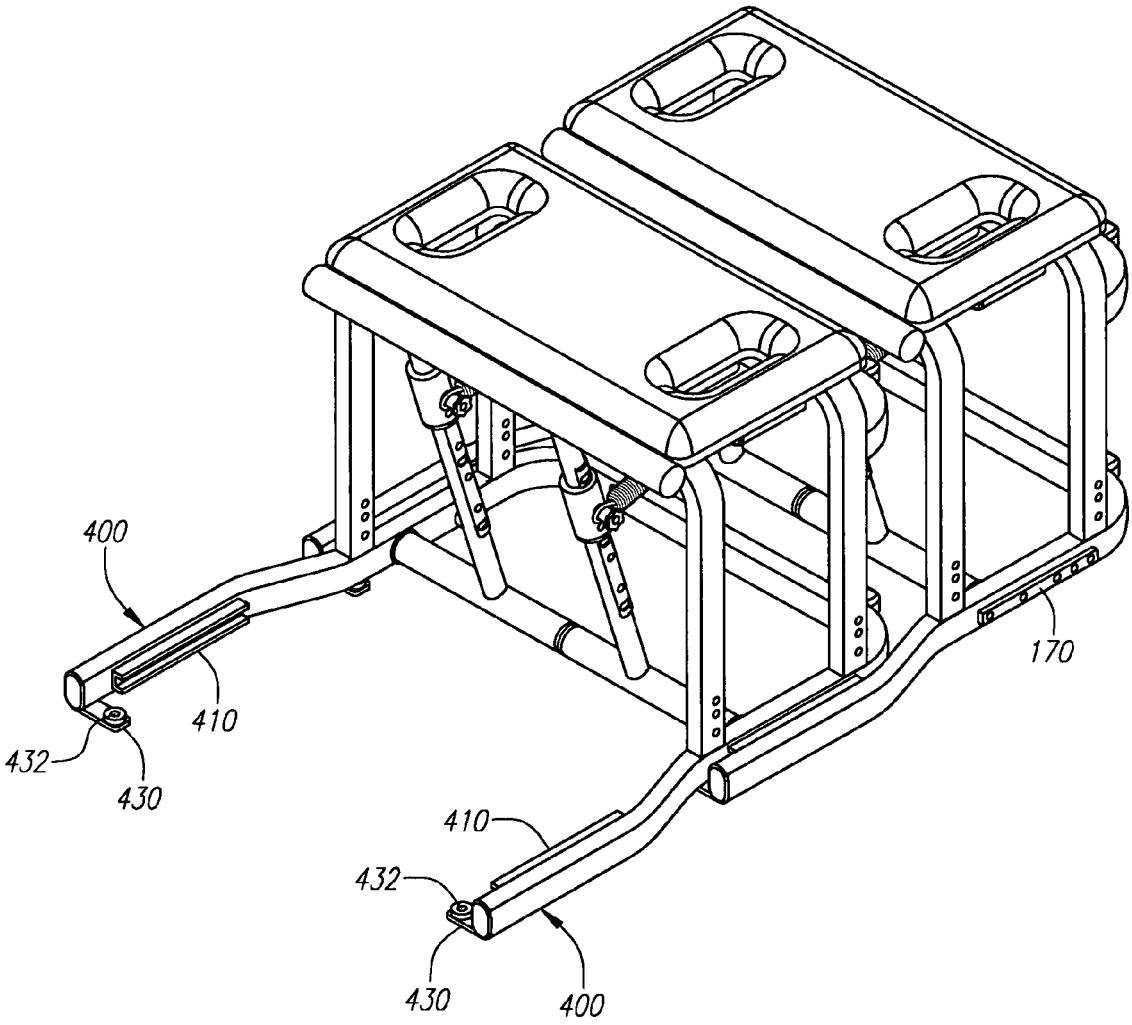
FIG. 10 shows a front downward view of two exercise chairs.
Figure 11:
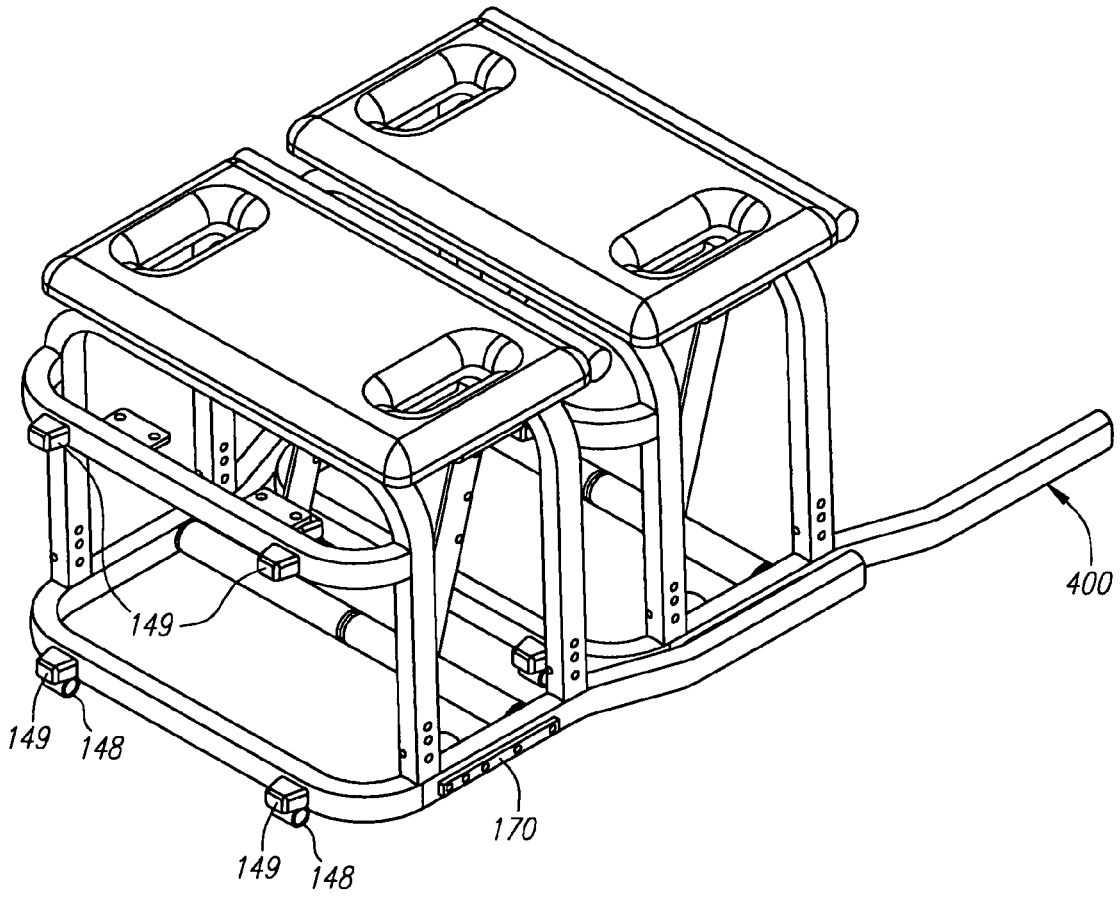
FIG. 11 shows a rear downward view of two exercise chairs.
Figure 12:
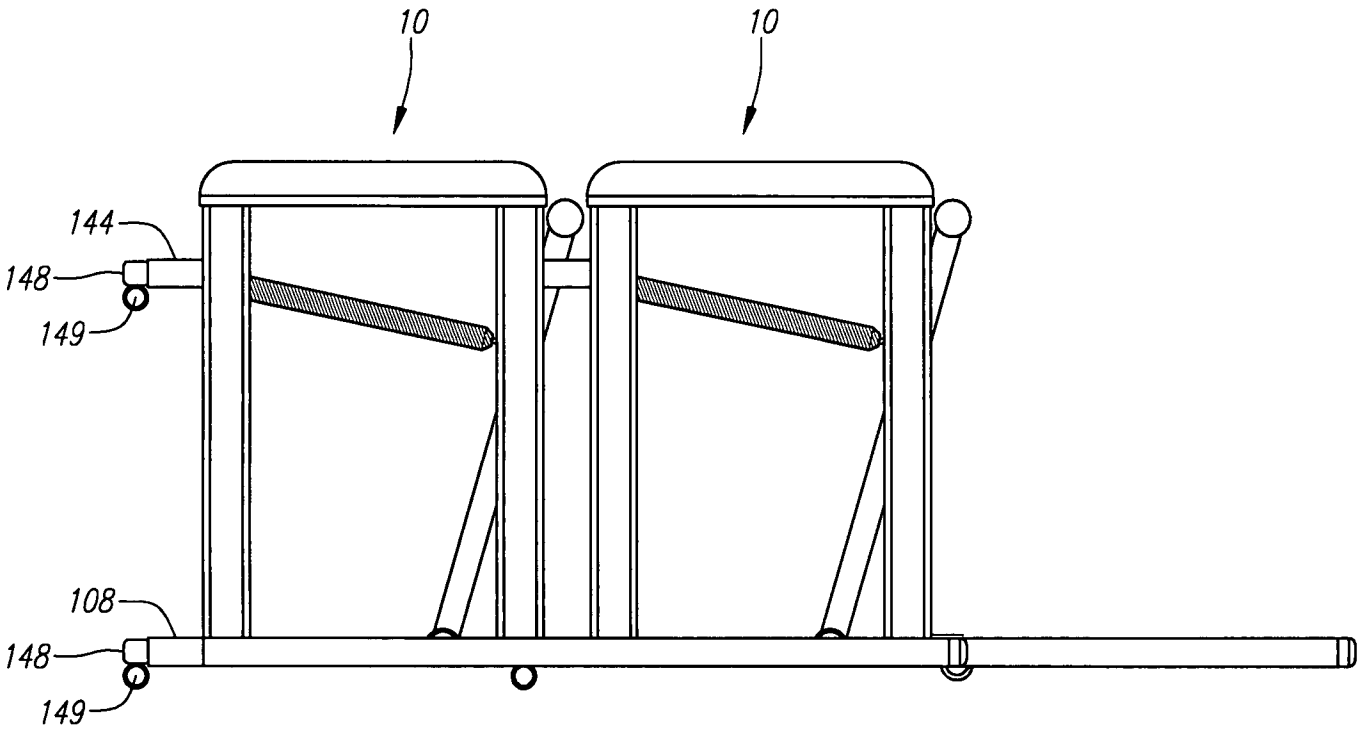
FIG. 12 shows two exercise chairs tilted up in a storage position.

The storage of multiple chairs 10 is now more fully described with reference to FIGS. 10-12. As shown, multiple chairs 10 may be lined up one behind the other. When the desired number of chairs have been lined up, the line of chairs may be tipped upward as shown in FIG. 12 so that the resulting footprint on the floor required by chairs 10 is relatively small. This manner of storage is advantageous over other stackable and folding chair designs for at least the following reasons.

First, a chair need not be picked up and stacked over another chair as in stackable designs. This is significant given the weight and bulky configuration of stackable chairs. Indeed, it would appear to require two individuals to stack chairs and only a limited number of chairs may be safely stacked. In contrast, the chairs 10 of the current invention may be easily lined up one behind the other to arrange chairs in a storage position. Once the desired number 10 of chairs are so arranged, the tipping action to tip the line of chairs up is relatively easy compared to having to pick multiple chairs straight up to stack it on top of another chair.

Second, chairs 10 need not be folded up, and components need not be rearranged, in order to store them. Instead, base 100 may remain in the same configuration when chair 10 is stored as when chair 10 is in use. This contributes to the rigidity and overall sturdy feel of chair 10 when in use. This also avoids moving parts which may wear out over time and sacrifice performance.

The components of chair 10 related to its storage are now more fully described. Chair 10 may include prongs 400 that are attached to frame 100. As shown in FIGS. 10-11, prongs 400 may be configured so that the base 100 of another chair may fit therebetween. One or both prongs 400 may include a rail 410 that may engage a rail 170 fitted on the lower side members 104*a* and 104*b* of lower frame member 102 of frame 100. Rails 410 preferably include one or more holes as shown in FIG. 3. As two chairs 10 are positioned together, rails 170 and 410 may engage each other in a male/female or other suitable arrangement. In this manner, the prongs 400 of one chair 10 may engage the base 100 of another chair 10.

Flanges 430, including cushion 432, may be positioned at the ends of prongs 400 to avoid pedals 330 from hitting the floor. Alternatively, flanges 430 and cushions 432 need not be used as discussed above.

In order to securely position consecutive chairs 10, frame 100 may include a pop pin 172 (as in FIG. 4) mounted to one or both of the lower side member(s) 104*a* and/or 104*b*. As shown in FIG. 4, the pop pin handle may extend inwardly of frame 100 and the pin may extend through the lower side member(s) 104*a* and/or 104*b* so that the pin may protrude from rail 170 when desired.

As chairs 10 are positioned together, the pin may be retracted so that rails 170 and 410 may engage each other. When chairs 10 have been positioned together the pin may be released so that it is inserted into one of the holes in rail 410 of prong 400. In this manner, two chairs 10 are securely positioned together. In an alternate embodiment, the pop pin may be attached to one or both prongs 400 so that the pin extends into holes in the rails 170 mounted to frame 100.

As shown, wheels 148 may be mounted to frame 100. In the embodiment shown, wheels 148 may be mounted to lower rear member 108. It is preferred that wheels 148 are mounted so that they do not engage the floor when chair 10 is horizontal. However, when chair 10 is tilted, such as that occurring when prongs 400 are lifted up, wheels 148 preferably do engage the floor. This may help position one chair 10 in line with another chair 10 when attaching multiple chairs 10 together to store, or to simply move one chair 10 to another location.

When two or more chairs have been together in a line, wheels 148 may also aid in transporting the line of chairs 10. That is, the prongs 400 of the forwardmost chair in the line may be picked up and the entire line of chairs 10 may be rolled to another location. It is believed that this is a relatively easy operation because an individual will have leverage to pick up the prongs 400 and rotate the line of chairs upward generally about the rear point of lower rear member 108 and/or the axis of wheels 149.

Figure 19:
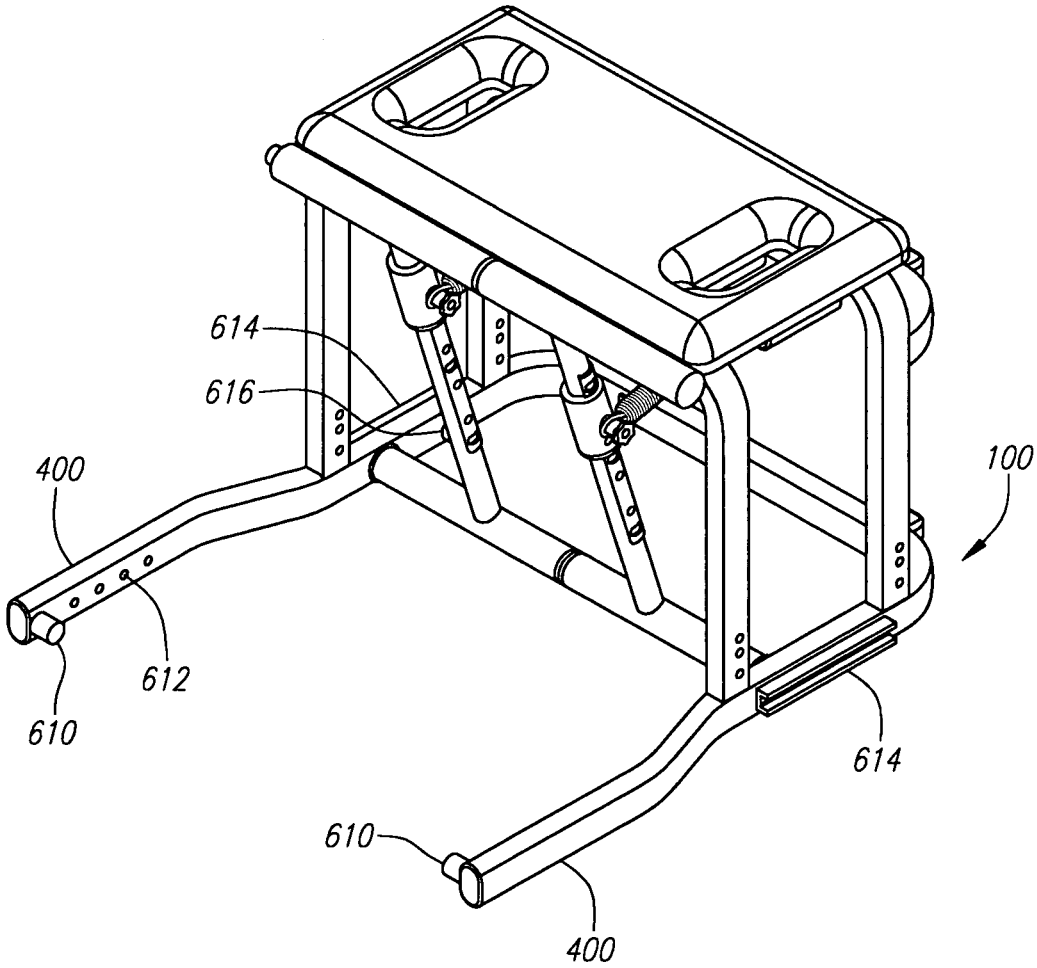
FIG. 19 shows an alternative device for engaging two chairs.

The invention contemplates a variety of ways for two chairs to engage each other. Another alternative is shown in FIG. 19 wherein wheels 610 may be mounted to prongs 400. Prong 400 may also include holes 612. Rails 614 may be mounted to base 100. In this manner, one chair may be lined up behind the other such that the wheels 610 engage rails 614, generally by wheels 610 sliding or moving within rails 614. In this manner, one chair may be moved closer to another chair in front of it. When the two chairs are sufficiently close together a pop pin 616 mounted to base 100, e.g., similar to how pop pin 172 is mounted to base 100 in FIG. 4, may be used to engage a hole 612 in prong 400.

The device 610 need not be wheels, but may instead comprise a pin, peg or any other member protruding from prong 400 that may engage rail 610. The member 610 need not necessarily be round, but may be of any other cross section that may engage rails 614. The wheel, pin, peg or other member 610 may be teflon coated as may the interior surface of rails 614 to facilitates two chairs being lined up one behind the other. Device 610 may replace tabs 430 and cushions 432 because device 610 may prevent pedals 330 from hitting the ground.

Figure 20:
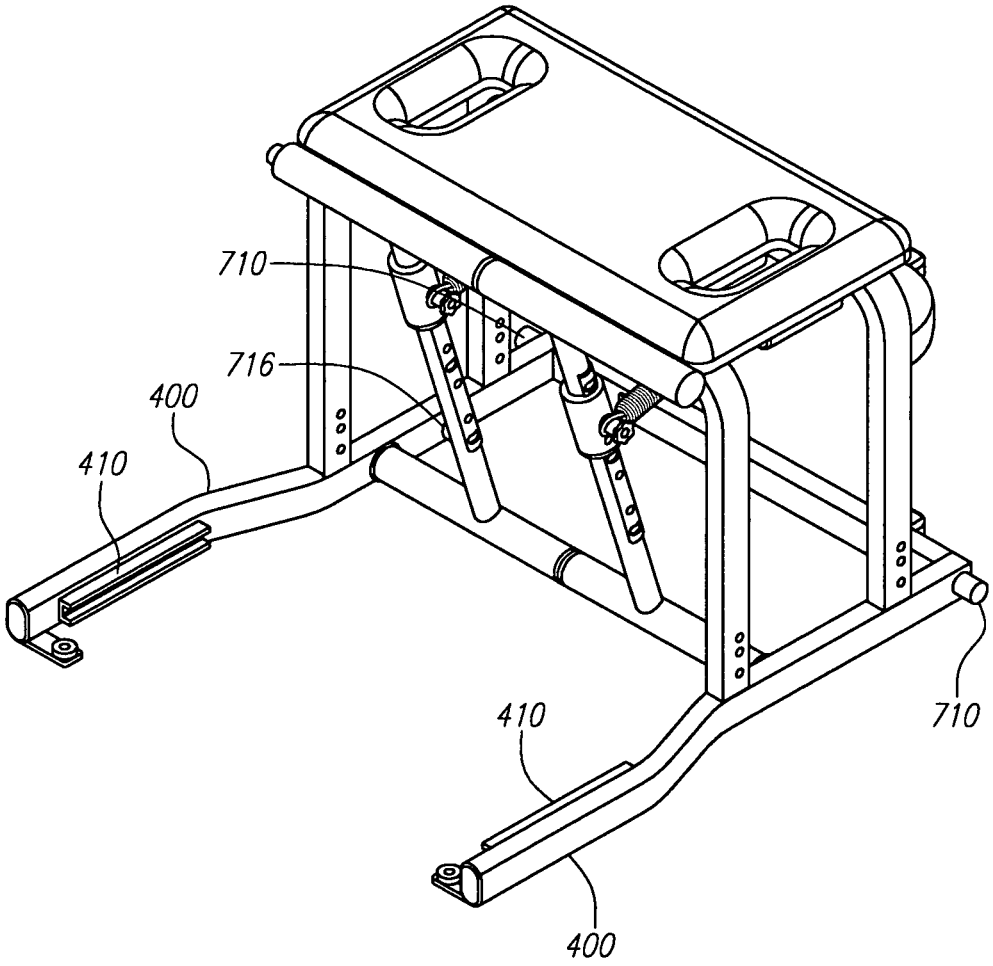
FIG. 20 shows an alternative device for engaging two chairs.

Another alternative embodiment for two chairs to engage each other is shown in FIG. 20. In this embodiment, wheels, tabs, pegs or other devices 710 may be attached to frame 100 as shown. The device 710 need not be round as noted above, and may be teflon coated as may be rails 410. In this embodiment, the members comprising the lower rear portion of frame 100 may be squared off so that device 710 may be positioned to engage rails 410 mounted to prongs 400. Alternatively, frame 100 need not be squared off as shown in FIG. 20, but may instead be rounded as shown in the other figures. Similar to the above-described embodiments, devices 710 engage rails 410 and then a pop pin 716 may be used once the chairs are sufficiently close.

Figure 21:
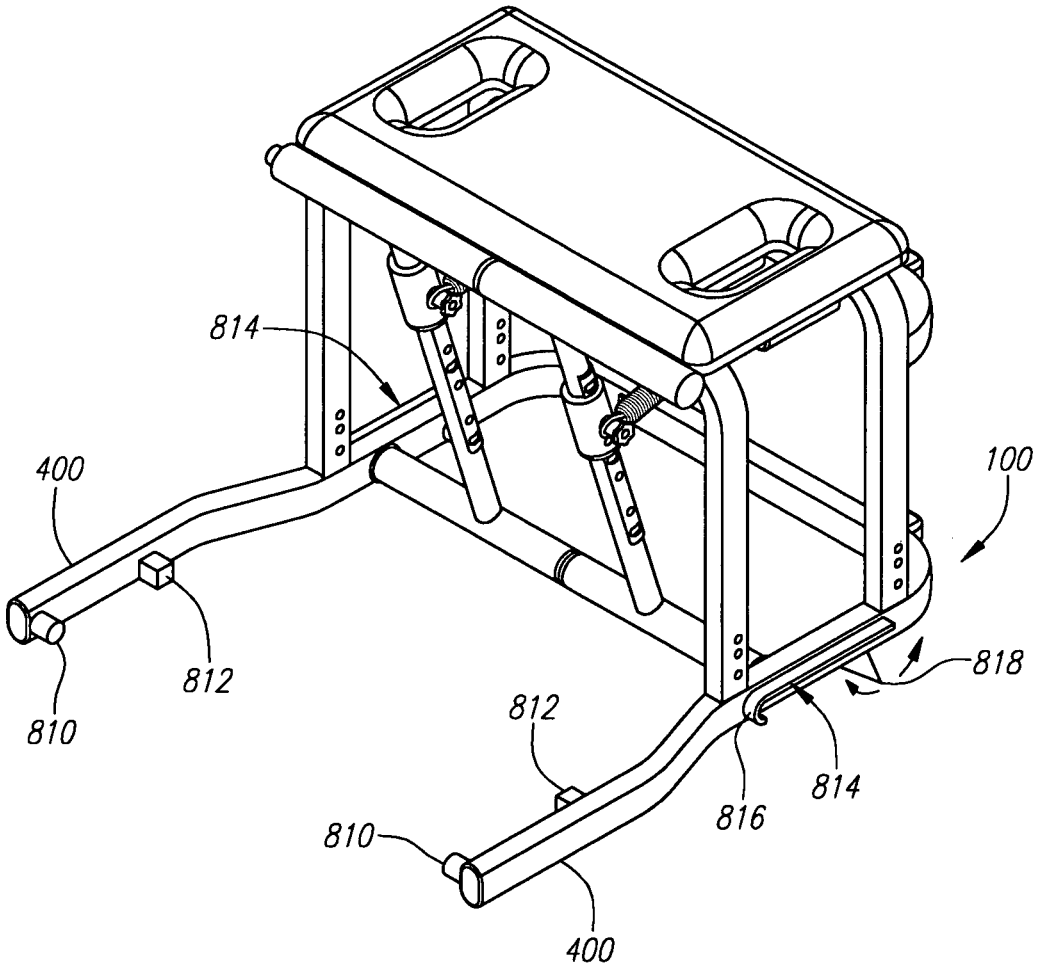
FIG. 21 shows an alternative device for engaging two chairs.

Another alternative embodiment for two chairs to engage each other is shown in FIG. 21. In this embodiment, devices 810 which may be similar to devices 610 and 710 discussed above may be mounted to prongs 400. Another member 812 may also be mounted to prongs 400. Members 812 are shown as square blocks in FIG. 21, but they may comprise other cross sectional shapes as well. Rails 814 may be attached to frame 100 as shown. In this embodiment, rails 814 may not have a lower flange as shown with the other rails. Rails 814 preferably have a J hook or other shaped closed section 814 at one end.

Similar to the embodiments described above, devices 810 may engage rails 814 as the two chairs are brought closer together. This embodiment may provide the advantage that devices 810 need not necessarily line up to fit between the upper and lower flanges of the rails. Instead, devices 810 may simply move underneath the flange (what had been the upper flange in the above-described rails) of rails 814. Devices 810 may then engage closed end 816 at which point the chairs are preferably sufficiently close together. Closed ends 816 preferably mate with the shape of devices 810, though this is not absolutely necessary. It is preferred that closed ends 816 generally keep devices 810 in position.

As devices 810 engage rails 814, so too may members 814 have moved under the flange of rails 814. When devices 810 engage the closed end 816, members 812 are preferably underneath rails 814. In this manner, the two chairs engage each other such that the prongs 400 of the forward chair may be picked up and both chairs may be tilted up and transported in a line as discussed above. That is, when the prongs 400 of the forward chair are picked up, the closed ends 816 supports devices 810 from the bottom and members 812 engage rails 814 from the top. As the chairs are tilted up, devices 810 and member 812 engage rails 814 to generally keep the two chairs in a line.

To help keep the two chairs engaged to each other, a lever 818 may be mounted to the bottom of frame 100 as shown and may rotate as indicated by the arrows in FIG. 21. Lever 818 may typically be positioned under frame 100. But when the two chairs are positioned together, lever may be rotated out so that it supports or engages the bottom of the prong 400 of the rear chair in the line. Both sides of frame 100 may have a lever 818.

The lever 818 need not be in the shape shown, but any device that engages the bottom of the prong may be used. To this end, hooks, clamps, bands and other devices that help secure the prongs of a rear chair to the frame of the forward chair may be used. To this end, this device 818 need not be mounted on the bottom of frame 100.

Figure 22A:
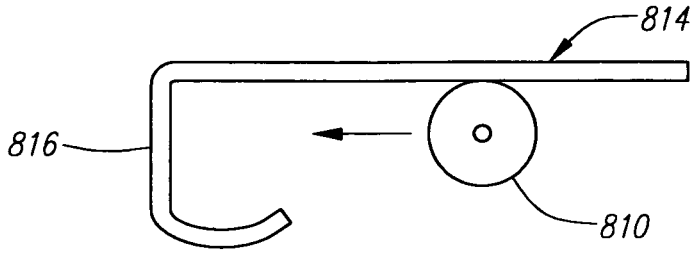
FIGS. 22A and 22AA shows an alternative device for engaging two chairs.
Figure 22A:
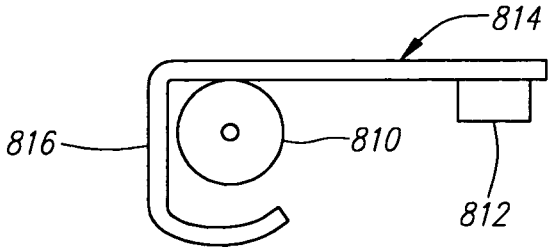
Figure 22B:
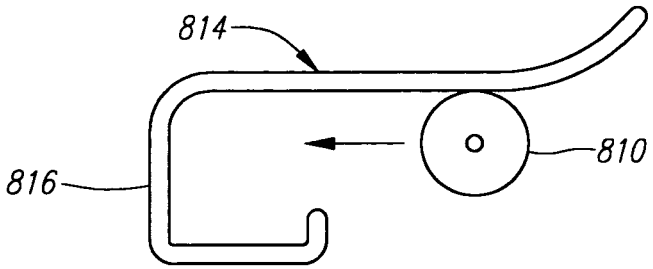
FIG. 22B shows an alternative device for engaging two chairs.
Figure 22C:
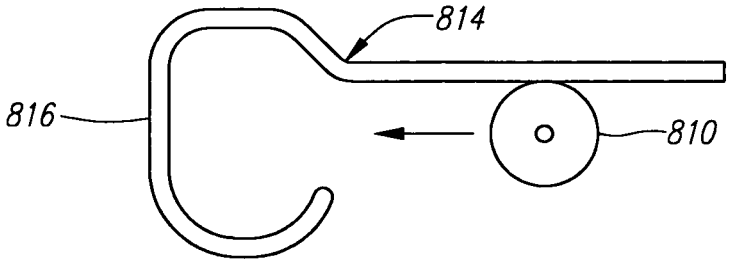
FIG. 22C shows an alternative device for engaging two chairs.

FIGS. 22A-22C show alternative rails 814 that may engage devices 810 and members 814 Again, devices 810 need not necessarily be round and members 812 need not necessarily be square. In FIG. 22B, the rear end of the rails 814 may be curved upward to help guide devices 810 under rails 814. The surface of devices 810, member 812 and rails 814 may be teflon coated to ease two chairs moving closer together. As described above, it is desired that devices 810 engage closed ends 816 so that closed ends 816 hold devices 810 generally in position. In this manner, when the prongs 400 of the forward chair are picked up, the closed ends 816 supports devices 810 from the bottom and members 812 engage rails 814 from the top.

The different means to engage two chairs together described above may be used as described or in combination with each other.

When the line of chairs is moved to the desired storage location, the line of chairs may be further tipped upward by the individual lifting the prongs 400 of the forwardmost chair further up so that the line of chairs is substantially vertical as shown in FIG. 12. At this point, the lower rear member 108 and upper rear member 144 of frame 100 are near the floor. To help the line of chairs rest in a vertical position, knobs 149 may be fitted to lower rear member 108 and upper rear member 144. Knobs 149 may comprise rubber or some other material that provides friction with the floor.

It can be seen that the vertical line of chairs occupies a relatively small footprint on the floor, which may be very important in smaller Pilates studios. Indeed, this small footprint is believed to be smaller than the footprint of stackable chairs. Furthermore, the tipping and rolling efforts required to move the line of chairs to their storage location is easier and safer than picking up heavy and bulky chairs to stack them and then sliding the stack of chairs to the desired storage location.

When it is desired to use the chairs 10 in the stored position, the vertical line of chairs may be tipped down to a horizontal position, and the chairs 10 may be detached from each other, and each chair 10 may be moved to the desired location for use. Again, chairs 10 are more easily and more safely moved from their storage position to the position where they will be used because tipping downward is easier than picking chairs straight up off a stack of chairs.

Figure 13:
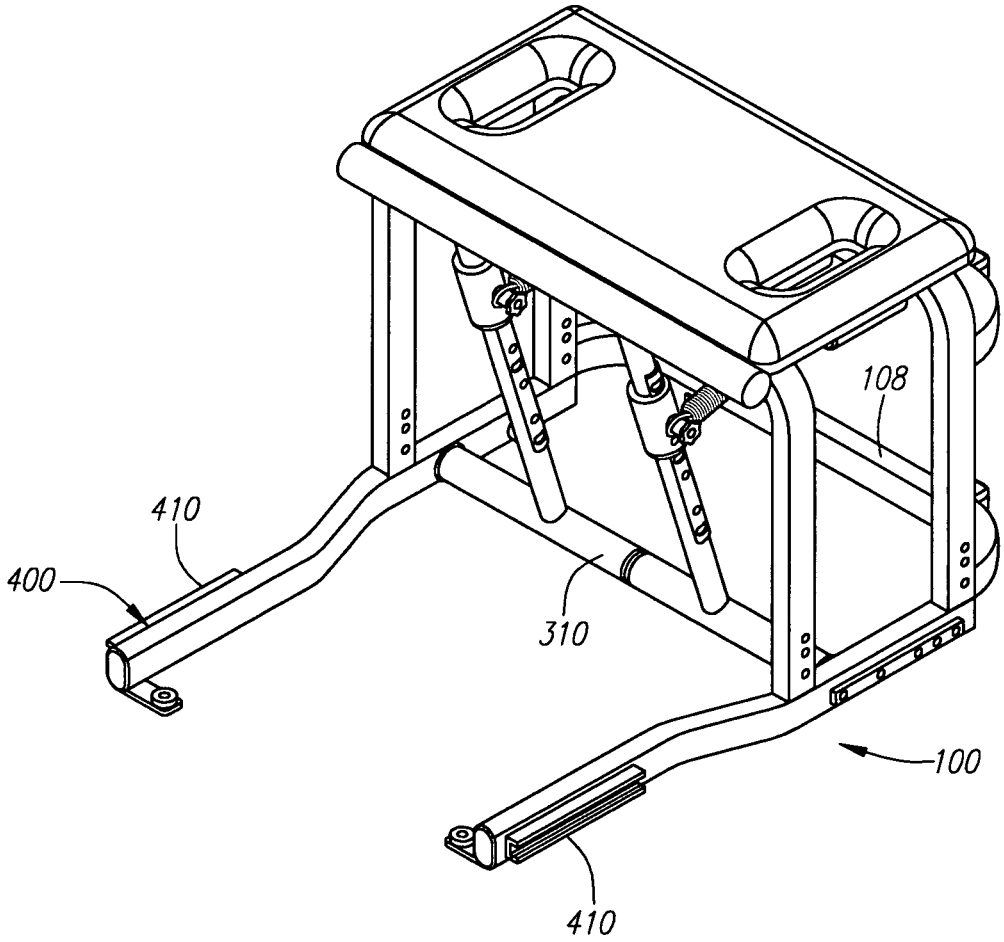
FIG. 13 shows an exercise chair having prongs of an alternate embodiment.

FIG. 13 shows an alternate configuration for prongs 400. In this embodiment, prongs 400 may be configured to fit within the frame 100 of the chair 10 in front of it in the line of chairs 10. In this embodiment, lower rear member 108 is mounted to the legs 132 so that prongs 400 may extend into the frame 100. Also in this embodiment, prongs 400 are preferably short enough so that they do not interfere with rod 310 when chairs 10 are lined up.

Figure 14:
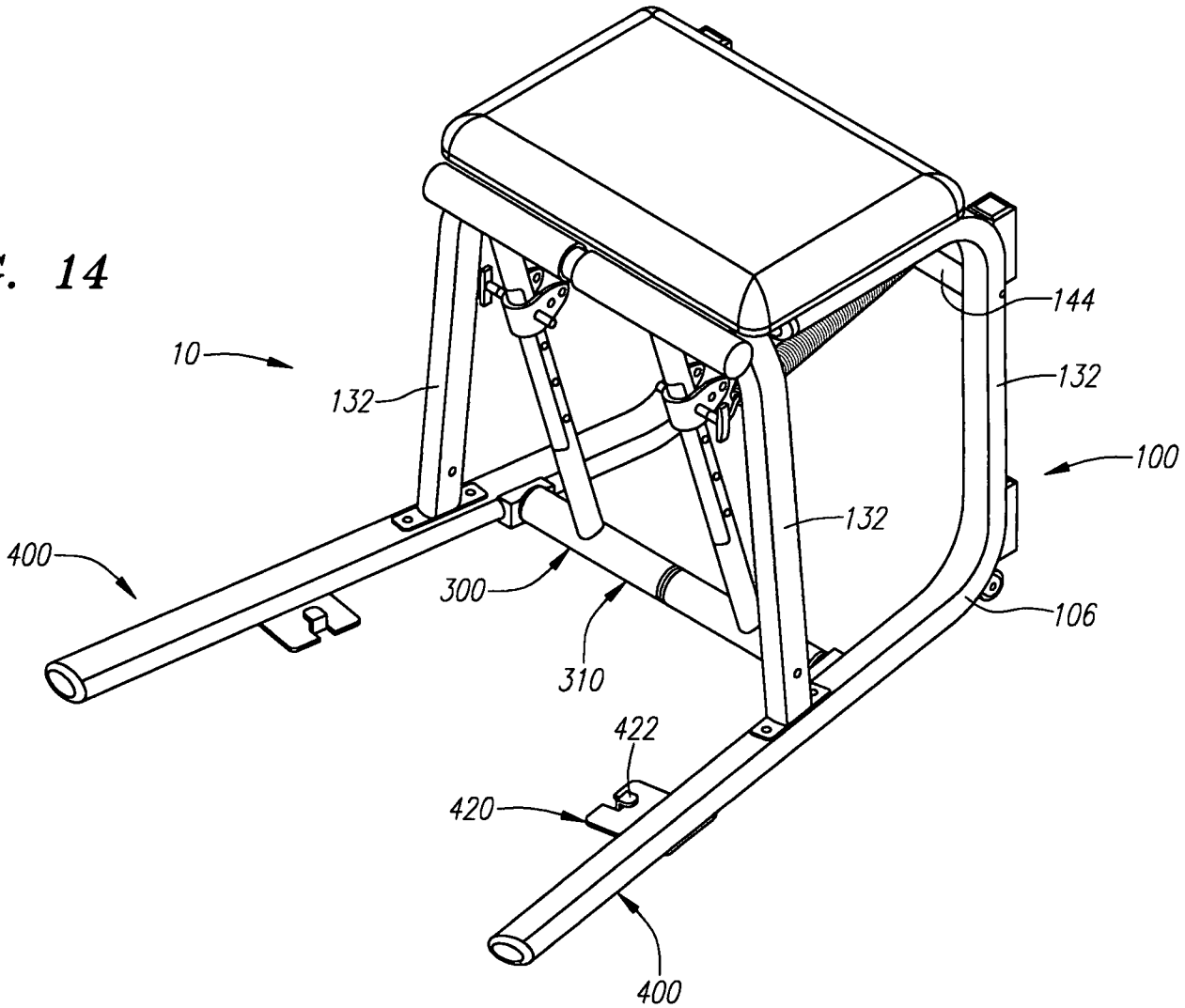
FIG. 14 shows an alternate embodiment chair.

Another embodiment of chair 10 is now discussed with reference to FIG. 14. Components that are common or similar to components discussed above are similarly numbered. In this embodiment, prongs 400 may be attached to, or form a contiguous part of, base 100. Prongs 400 may extend forward in a V-shape. Upper rear member 144 may also comprise a straight bar between legs 132.

Figure 15:
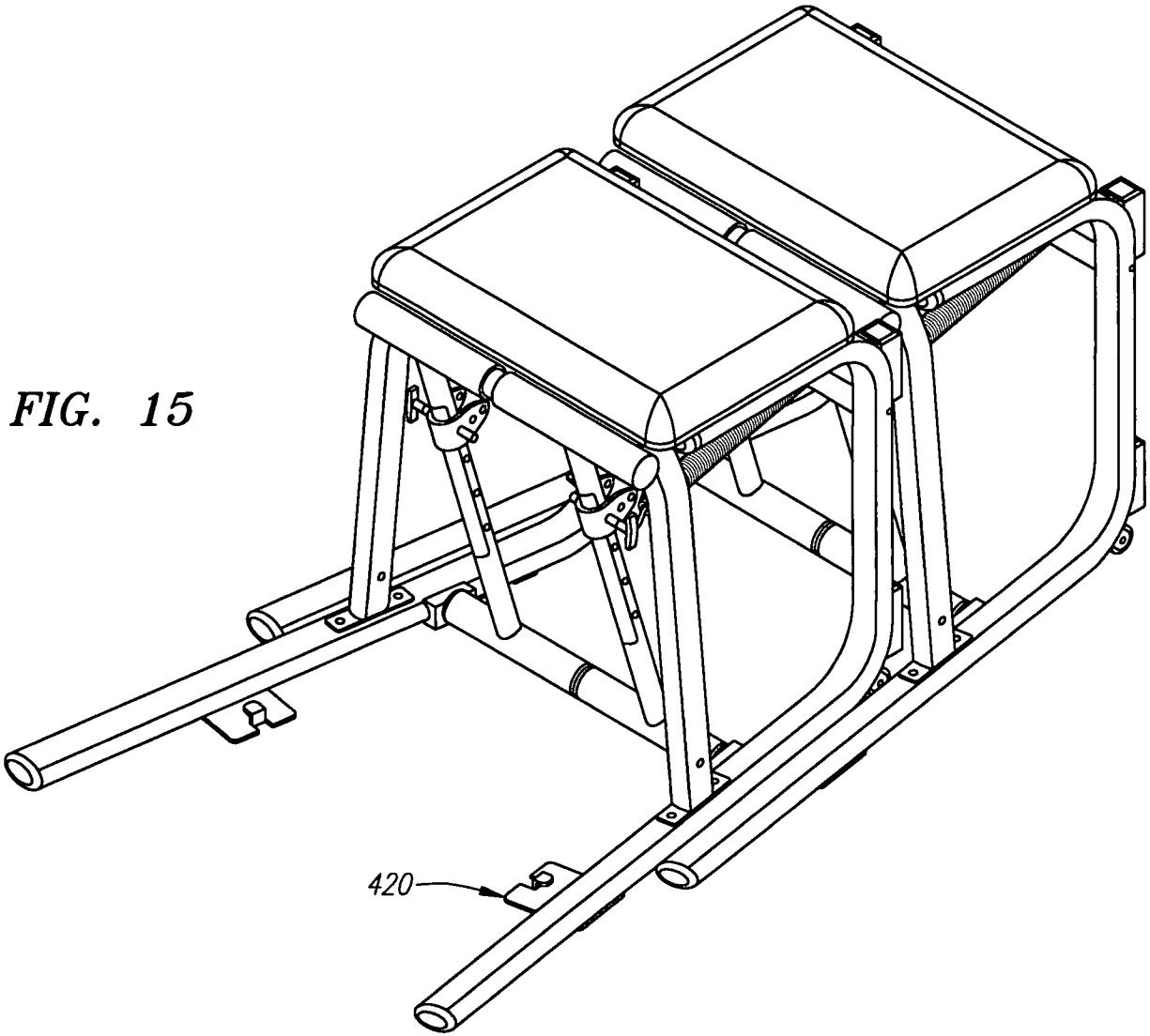
FIG. 15 shows a front downward perspective view of two alternative embodiment chairs lined up together.
Figure 16:
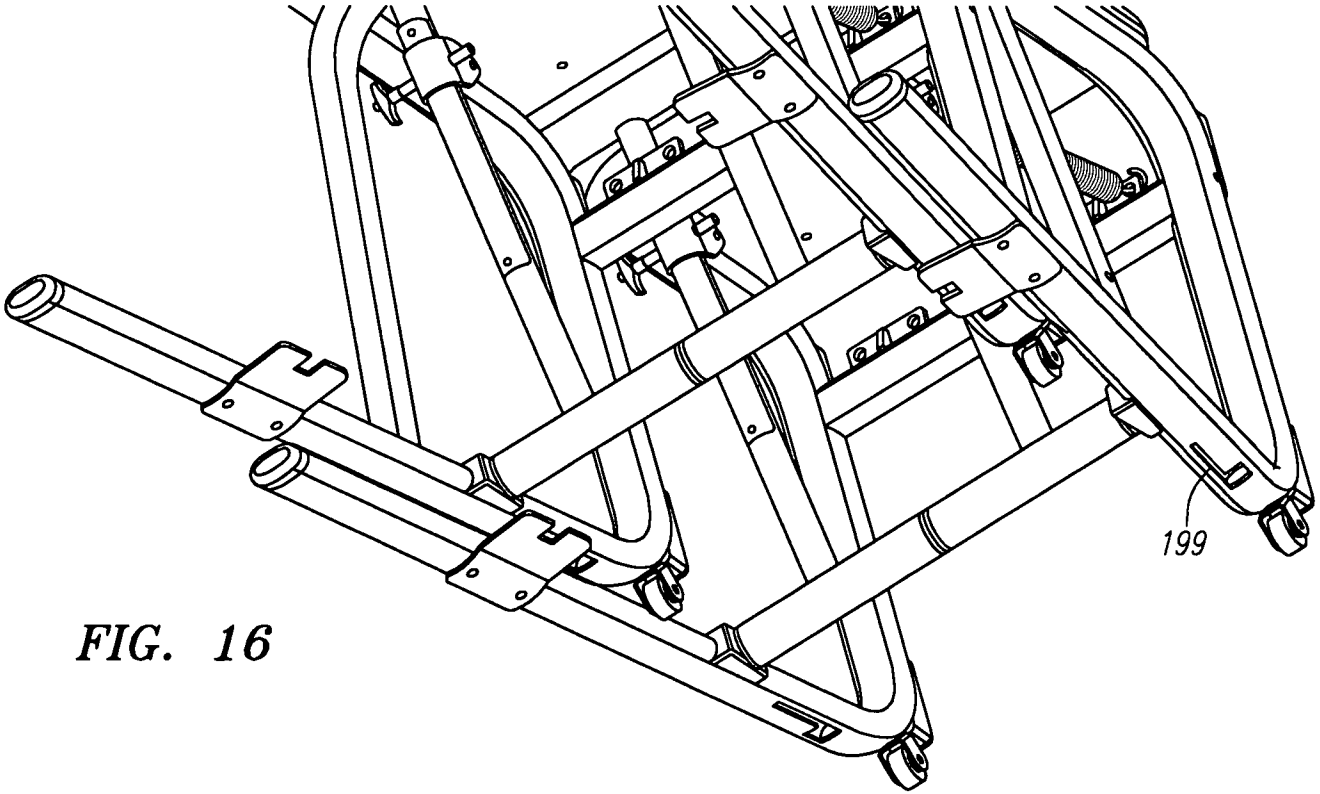
FIG. 16 shows a front upward perspective view of two alternate embodiment chairs lined up together.

FIGS. 15-16 show how two chairs 10 of this embodiment may be positioned together. As shown, prongs 400 may include flange 420 that in turn includes a tab 422. As chairs 10 are lined up, the tab 422 of one chair may fit into a slot 199 in the base 100 of the chair 10 in front of it. As such, multiple chairs 10 may be locked together. The line of chairs may then be wheeled to the storage location and tipped to a vertical position.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. An exercise chair, comprising:

a base;

a seat mounted to the base and having a front and a rear;

a lever mounted to the base and configured to be pressed down;

at least one spring connected to the lever and to the base; and a pair of prongs extending from the base forwardly beyond the front of the seat, wherein at least one of the prongs includes a device configured to engage, forward of the front of the seat, a base of a second exercise chair that is substantially similar to the exercise chair, so that when engaged with the base of the second exercise chair, the exercise chair and the second exercise chair are attached front-to-back and may be moved as a unit.

2. The exercise chair of claim 1, further comprising at least one first rail mounted to the base, and wherein the device is a second rail mounted to at least one of the prongs, wherein the second rail is configured to releasably attach to the base of the second exercise chair.

3. The exercise chair of claim 2, wherein the second rail is configured to releasably attach to a rail mounted to the base of the second exercise chair, when the exercise chair is positioned behind the second exercise chair.

4. The exercise chair of claim 1, further comprising a locking device fixedly mounted to the frame, wherein the locking device is configured to lock to a prong of another exercise chair, when the other exercise chair is positioned behind the exercise chair.

5. The exercise chair of claim 4 wherein the locking device is a pop pin.

6. The exercise chair of claim 1, wherein the prongs are separated by a width that is wider than the base of the second exercise chair and each prong is configured to releasably attach to opposite sides of the base of the second exercise chair.

7. The exercise chair of claim 1, further comprising a pair of transition pieces which couple the pair of prongs to the base.

8. An exercise chair, comprising:

a base having a lower portion, an upper portion, a first side and second side;

a seat mounted to the upper portion of the base;

a lever pivotally mounted to the lower portion of the base and extending upward towards the seat and configured to be pressed down;

at least one spring connected to the lever and to the base; and a pair of prongs extending from the lower portion of the base on the first and second sides forwardly beyond the front of the seat, wherein at least one of the prongs includes a device configured to engage, forward of the front of the seat, a corresponding side of a base of a second exercise chair that is substantially similar to the exercise chair, so that when engaged with the base of the second exercise chair, the exercise chair and the second exercise chair are attached front-to-back and may be moved as a unit.

9. The exercise chair of claim 8, further comprising at least one first rail mounted to the lower portion of the base, and wherein the device is a second rail mounted to at least one of the prongs, wherein the second rail is configured to releasably attach to the base of the second exercise chair.

10. The exercise chair of claim 9, wherein the second rail is configured to releasably attach to a rail mounted to a lower portion of the base of the second chair, when the exercise chair is positioned behind the second exercise chair.

11. The exercise chair of claim 8, further comprising a locking device fixedly mounted to the base and configured to lock to a prong of another exercise chair, when the other exercise chair is positioned behind the exercise chair.

12. The exercise chair of claim 11, wherein the locking device is a pop pin.

13. The exercise chair of claim 8, further comprising an attachment means mounted to the lower portion of the base and configured to attach to a device attached to at least one of the prongs of the second exercise chair when the second exercise chair is positioned behind the exercise chair.

14. The exercise chair of claim 8, wherein the device comprises an attachment means mounted to a prong and configured to attach to a lower portion of a base of the second exercise chair when the exercise chair is positioned behind the second exercise chair.

15. An exercise chair, comprising:

a base having a lower frame and an upper frame;

a seat mounted to the upper frame of the base;

a lever pivotally mounted to the lower frame of the base and extending upward toward the seat and configured to be pressed down;

at least one spring connected to the lever and to the base;

a pair of prongs attached to the lower frame of the base configured to engage a base of a substantially similar second exercise chair, so that when the prongs of the exercise chair are engaged with the base of the second exercise chair, the exercise chair and the second exercise chair are attached and may be moved as a unit when the exercise chair is placed behind the second exercise chair; and a locking device fixedly attached to the base and configured to lock to a prong of another substantially similar exercise chair, when the other exercise chair is positioned behind the exercise chair.

16. The exercise chair of claim 15, wherein the locking device is a pop pin.

17. The exercise chair of claim 15, wherein the prongs are separated by a distance that is approximately equal to a width of the base of the second exercise chair so that the second exercise chair may fit between the prongs of the exercise chair when the exercise chair is placed behind the second exercise chair.

* * * * *